US011248277B2

(12) United States Patent
Terashima et al.

(10) Patent No.: US 11,248,277 B2
(45) Date of Patent: Feb. 15, 2022

(54) METHOD FOR MANUFACTURING HIGH-STRENGTH GALVANIZED STEEL SHEET

(71) Applicant: JFE STEEL CORPORATION, Tokyo (JP)

(72) Inventors: Shotaro Terashima, Tokyo (JP); Yusuke Fushiwaki, Tokyo (JP); Yoichi Makimizu, Tokyo (JP); Hiroyuki Masuoka, Tokyo (JP); Hiroshi Hasegawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 190 days.

(21) Appl. No.: 16/615,004

(22) PCT Filed: Apr. 24, 2018

(86) PCT No.: PCT/JP2018/016546
§ 371 (c)(1),
(2) Date: Nov. 19, 2019

(87) PCT Pub. No.: WO2018/211920
PCT Pub. Date: Nov. 22, 2018

(65) Prior Publication Data

US 2020/0199705 A1 Jun. 25, 2020

(30) Foreign Application Priority Data

May 19, 2017 (JP) ..... JP2017-099448

(51) Int. Cl.

| | |
|---|---|
| ***C21D 9/46*** | (2006.01) |
| ***C23C 2/02*** | (2006.01) |
| ***C23C 2/06*** | (2006.01) |
| ***C23G 1/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/20*** | (2006.01) |
| ***C22C 38/32*** | (2006.01) |

(52) U.S. Cl.
CPC ..... *C21D 9/46* (2013.01); *C22C 38/001* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/20* (2013.01); *C22C 38/32* (2013.01); *C23C 2/02* (2013.01); *C23C 2/06* (2013.01); *C23G 1/081* (2013.01); *C23G 1/085* (2013.01); *C23G 1/086* (2013.01); *C23G 1/088* (2013.01)

(58) Field of Classification Search
CPC ..... C21D 9/46; C22C 38/00; C22C 38/001; C22C 38/005; C22C 38/02; C22C 38/04; C22C 38/06; C22C 38/08; C22C 38/12; C22C 38/14; C22C 38/20; C22C 38/32; C22C 38/60; C23C 2/02; C23C 2/06; C23C 2/28; C23C 2/40; C23C 28/00; C23G 1/00; C23G 1/081; C23G 1/083; C23G 1/085; C23G 1/086; C23G 1/088
See application file for complete search history.

(56) References Cited

FOREIGN PATENT DOCUMENTS

| | | | | |
|---|---|---|---|---|
| CN | 101255541 | A | | 9/2008 |
| EP | 2 612 957 | A1 | | 7/2013 |
| EP | 3 034 646 | A1 | | 6/2016 |
| EP | 3272892 | A1 | | 1/2018 |
| JP | 2000-290730 | A | | 10/2000 |
| JP | 2003-328099 | A | | 11/2003 |
| JP | 2004-149912 | A | | 5/2004 |
| JP | 2004149912 | A | * | 5/2004 |
| JP | 3956550 | B2 | | 8/2007 |
| JP | 2007-239012 | A | | 9/2007 |
| JP | 2012-172230 | A | | 9/2012 |

(Continued)

OTHER PUBLICATIONS

Feb. 8, 2021 Office Action issued in Chinese Patent Application No. 201880031133.1.
Apr. 6, 2020 Extended European Search Report issued in European Patent Application No. 18803047.2.
Lin et al., "Annealing and Galvanizing Reactions of Hot-Rolled-in Scale on a Mn/Si Steel Sheet", China Steel Technical Report, No. 26, pp. 32-37, 2013.

(Continued)

*Primary Examiner* — Jenny R Wu
(74) *Attorney, Agent, or Firm* — Oliff PLC

(57) ABSTRACT

A method for manufacturing a high-strength galvanized steel sheet having excellent strength-elongation balance, coating adhesiveness, and surface appearance. The method includes: (i) a first heating process of heating a steel sheet having a predetermined chemical composition, (ii) a first pickling process of pickling the steel sheet which was subjected to the first heating process in an oxidizing acidic aqueous solution, (iii) a second pickling process of pickling the steel sheet which was subjected to the first pickling process in a non-oxidizing acidic aqueous solution, (iv) a second heating process of holding the steel sheet, which was subjected to the second pickling process, at a temperature range of 700° C. or higher and 900° C. or lower in a hydrogen-containing atmosphere for 20 seconds or more and 300 seconds or less, and (v) performing a galvanizing treatment on the steel sheet which was subjected to the second heating process.

14 Claims, No Drawings

(56) References Cited

FOREIGN PATENT DOCUMENTS

| | | | | | |
|---|---|---|---|---|---|
| JP | 2013173976 | A | * | 9/2013 | ..... C23G 1/00 |
| JP | 2015-180766 | A | | 10/2015 | |
| JP | 2015180766 | A | * | 10/2015 | ..... C21D 9/46 |
| JP | WO2016002141 | A1 | | 4/2017 | |
| KR | 10-2013-0031285 | A | | 3/2013 | |
| KR | 10-2016-0043012 | A | | 4/2016 | |
| WO | 2016/147549 | A1 | | 9/2016 | |

OTHER PUBLICATIONS

Jul. 3, 2018 International Search Report issued in International Patent Application No. PCT/JP2018/016546.

Jul. 3, 2018 Written Opinion issued in International Patent Application No. PCT/JP2018/016546.

Oct. 29, 2019 Office Action issued in Japanese Patent Application No. 2017-099448.

Dec. 15, 2020 Office Action issued Korean Patent Application No. 10-2019-7033654.

May 25, 2021 Notice of Allowance issued in Korean Patent Application No. 10-2019-7033654.

Aug. 18, 2021 Office Action issued in Chinese Patent Application No. 201880031133.1.

* cited by examiner

METHOD FOR MANUFACTURING HIGH-STRENGTH GALVANIZED STEEL SHEET

TECHNICAL FIELD

This application relates to a method for manufacturing a high-strength galvanized steel sheet which can preferably be used for automobile members.

BACKGROUND

Nowadays, there is a strong demand for improving fuel efficiency to reduce the amount of $CO_2$ emissions from automobiles from the viewpoint of global environment conservation. In response to such a demand, since there is an active trend toward decreasing the thickness of automobile body parts to reduce the weight of automobile bodies, there is an increasing need for increasing the strength of a steel sheet, which is a material for automobile body parts.

To increase the strength of a steel sheet, adding solid solution-strengthening elements, such as Si and Mn, is effective. However, since such elements are easily oxidizable elements, which are oxidized more readily than Fe, the following problems exist in the case where a galvanized steel sheet or a galvannealed steel sheet whose base steel is a high-strength steel sheet containing large amounts of such elements is manufactured.

Usually, to manufacture a galvanized steel sheet, a galvanizing treatment is performed after a steel sheet is subjected to heating and annealing at a temperature of approximately 600° C. to 900° C. in a non-oxidizing atmosphere or in a reducing atmosphere. Easily oxidizable elements in steel are selectively oxidized even in a non-oxidizing atmosphere or a reducing atmosphere, which is generally used, and concentrated on the surface of a steel sheet to form oxides on the surface. Since such oxides deteriorate wettability between the surface of the steel sheet and molten zinc when a galvanizing treatment is performed, there is a rapid deterioration in coating wettability with an increase in the concentration of easily oxidizable elements in steel, which results in frequent non-coating occurring. Even in the case where non-coating does not occur, since oxides exist between a steel sheet and a coating layer, there is a deterioration in coating adhesiveness. In particular, since only a small amount of Si added markedly deteriorates the wettability with molten zinc, Mn, whose effect on wettability is less than that of Si, is added in many cases when a galvanized steel sheet is manufactured. However, since Mn oxides also deteriorate the wettability with molten zinc, the problem of non-coating becomes marked in the case where a large amount of Mn is added.

In response to such problems, Patent Literature 1 proposes a method in which, after annealing has been performed on a steel sheet, pickling is performed to dissolve and remove oxides formed on the surface of the steel sheet, annealing is thereafter performed again, and a galvanizing treatment is performed. However, when this method is used in the case where large amounts of alloy elements are added, since oxides are formed on the surface of the steel sheet again when annealing is performed again, there may be a deterioration in coating adhesiveness even in the case where surface appearance defects, such as non-coating, do not occur.

Examples of a method for improving coating adhesiveness include one in which minute asperity is formed on the surface of a steel sheet to achieve an anchor effect at a coating interface. Patent Literature 2 proposes a method in which sphere-shaped or massive Mn oxides, which are formed on the surface of a Mn-containing steel sheet after the steel sheet has been annealed, are pressed onto the surface of the steel sheet by performing rolling and then removed by performing pickling to form minute asperity on the surface of the steel sheet. However, in the case of this method, it is necessary to add a rolling process after an annealing process. Moreover, although this method is effective in the case of steel containing Mn, which is likely to form sphere-shaped or massive oxides after annealing has been performed, this method is less effective in the case of high-Si-containing steel, which is likely to form film-shaped oxides. In addition, since it is difficult to remove Si oxides in a subsequent pickling process due to poor reactivity thereof, the upper limit of the acceptable amount of Si added is comparatively small, that is, 0.80%, which is not sufficient to achieve the effect of achieving an excellent strength-elongation balance caused by adding Si.

CITATION LIST

Patent Literature

PTL 1: Japanese Patent No. 3956550
PTL 2: Japanese Patent Application No. 2015-551886

SUMMARY

Technical Problem

In view of the situation described above, an object of the disclosed embodiments is to provide a method for manufacturing a high-strength galvanized steel sheet excellent in terms of strength-elongation balance, coating adhesiveness, and surface appearance.

Solution to Problem

The present inventors diligently conducted investigations and studies to solve the problems described above and, as a result, found that, by performing annealing, pickling in an oxidizing aqueous solution, rinsing in water, pickling in a non-oxidizing aqueous solution, and rinsing in water in this order on Si-containing steel, since Si oxides formed on the surface of the steel are removed along with the base steel grains, it is possible to achieve a clean steel sheet surface, which makes it possible to perform a galvanizing treatment on the surface of the steel sheet after subsequent second annealing has been performed. It was found that, since this makes it possible to use a material design involving two annealing processes even in the case of Si-containing steel, it is possible to manufacture a galvanized steel sheet excellent in terms of strength (TS)-elongation (El) balance. Moreover, it was found that, as an additional effect, since minute asperity is formed on the surface of a steel sheet which has been pickled in an oxidizing aqueous solution, there is an improvement in coating adhesiveness due to an anchor effect at a coating interface after galvanizing treatment has been performed.

The disclosed embodiments have been made on the basis of the knowledge described above, and the exemplary embodiments are as follows.

[1] A method for manufacturing a high-strength galvanized steel sheet, the method including a first heating process of heating a steel sheet having a chemical composition containing, by mass %, C: 0.040% or more and 0.500% or less, Si: 0.80% or more and 2.00% or less, Mn: 1.00% or more and 4.00% or less, P: 0.100% or less, S: 0.0100% or less, Al: 0.100% or less, N: 0.0100% or less, and a balance of Fe and inevitable impurities to a temperature range of 800° C. or higher and 950° C. or lower in an atmosphere having a $H_2$ concentration of 0.05 vol % or more and 30.0 vol % or less and a dew point of 0° C. or lower, a first pickling process of pickling the steel sheet which has been subjected to the first heating process in an oxidizing acidic aqueous solution and of rinsing the pickled steel sheet in water, a second pickling process of pickling the steel sheet which has been subjected to the first pickling process in a non-oxidizing acidic aqueous solution and of rinsing the pickled steel sheet in water, a second heating process of holding the steel sheet which has been subjected to the second pickling process in a temperature range of 700° C. or higher and 900° C. or lower in an atmosphere having a $H_2$ concentration of 0.05 vol % or more and 30.0 vol % or less and a dew point of 0° C. or lower for 20 seconds or more and 300 seconds or less, and a process of performing a galvanizing treatment on the steel sheet which has been subjected to the second heating process.

[2] The method for manufacturing a high-strength galvanized steel sheet according to item [1], in which the chemical composition further contains, by mass %, at least one selected from Ti: 0.010% or more and 0.100% or less, Nb: 0.010% or more and 0.100% or less, and B: 0.0001% or more and 0.0050% or less.

[3] The method for manufacturing a high-strength galvanized steel sheet according to item [1] or [2], in which the chemical composition further contains, by mass %, at least one selected from Mo: 0.01% or more and 0.50% or less, Cr: 0.60% or less, Ni: 0.50% or less, Cu: 1.00% or less, V: 0.500% or less, Sb: 0.10% or less, Sn: 0.10% or less, Ca: 0.0100% or less, and REM: 0.010% or less.

[4] The method for manufacturing a high-strength galvanized steel sheet according to any one of items [1] to [3], the method further including an oxidizing process of heating the steel sheet to a temperature range of 400° C. or higher and 900° C. or lower in an atmosphere having an $O_2$ concentration of 0.1 vol % or more and 20 vol % or less and a $H_2O$ concentration of 1 vol % or more and 50 vol % or less after the second pickling process and before the second heating process.

[5] The method for manufacturing a high-strength galvanized steel sheet according to item [4], the method further including a reducing process of heating the steel sheet to a temperature range of 600° C. or higher and 900° C. or lower in an atmosphere having an $O_2$ concentration of 0.01 vol % or more and less than 0.1 vol % and a $H_2O$ concentration of 1 vol % or more and 20 vol % or less after the oxidizing process.

[6] The method for manufacturing a high-strength galvanized steel sheet according to any one of items [1] to [5], in which the oxidizing acidic aqueous solution in the first pickling process is nitric acid or a mixture of nitric acid and at least one selected from hydrochloric acid, hydrofluoric acid, and sulfuric acid.

[7] The method for manufacturing a high-strength galvanized steel sheet according to any one of items [1] to [6], in which the non-oxidizing acidic aqueous solution in the second pickling process is a mixture of one, two, or more selected from hydrochloric acid, sulfuric acid, phosphoric acid, pyrophosphoric acid, formic acid, acetic acid, citric acid, hydrofluoric acid, and oxalic acid.

[8] The method for manufacturing a high-strength galvanized steel sheet according to any one of items [1] to [7], the method further including an alloying treatment process of performing an alloying treatment on the steel sheet which has been subjected to the process of performing a galvanizing treatment.

Advantageous Effects

According to the disclosed embodiments, it is possible to obtain a high-strength galvanized steel sheet excellent in terms of strength-elongation balance, surface appearance, and coating adhesiveness. By using the high-strength galvanized steel sheet according to the disclosed embodiments for, for example, the structural members of automobiles, it is possible to improve fuel efficiency due to weight reduction of automobile bodies.

DETAILED DESCRIPTION

Hereafter, the embodiments of the present application will be described. Here, the present application is not limited to the embodiments below. In addition, "%" used when describing a chemical composition refers to "mass %".

First, the chemical composition will be described.

The chemical composition contains, by mass %, C: 0.040% or more and 0.500% or less, Si: 0.80% or more and 2.00% or less, Mn: 1.00% or more and 4.00% or less, P: 0.100% or less, S: 0.0100% or less, Al: 0.100% or less, and N: 0.0100% or less, and the balance is Fe and inevitable impurities. In addition, the chemical composition may further contain, at least one selected from Ti: 0.010% or more and 0.100% or less, Nb: 0.010% or more and 0.100% or less, and B: 0.0001% or more and 0.0050% or less. In addition, the chemical composition may further contain, at least one selected from Mo: 0.01% or more and 0.50% or less, Cr: 0.60% or less, Ni: 0.50% or less, Cu: 1.00% or less, V: 0.500% or less, Sb: 0.10% or less, Sn: 0.10% or less, Ca: 0.0100% or less, and REM: 0.010% or less. Hereafter, each of the constituents will be described.

C: 0.040% or More and 0.500% or Less

C is an element which stabilizes austenite and which is effective for improving strength and ductility. To achieve such effects, the C content is set to be 0.040% or more. On the other hand, in the case where the C content is more than 0.500%, there is a marked deterioration in weldability, and there may be a case where it is not possible to achieve an excellent strength-elongation balance due to an excessively hardened martensite phase. Therefore, the C content is set to be 0.500% or less.

Si: 0.80% or More and 2.00% or Less

Si is an element which stabilizes ferrite. Si is also effective for increasing the strength of steel through solid solution strengthening, and improves strength-elongation balance. In the case where the Si content is less than 0.80%, it is not possible to achieve such effects. On the other hand, in the case where the Si content is more than 2.00%, since Si forms oxides on the surface of a steel sheet during annealing, there is a deterioration in wettability between the steel sheet and molten zinc when galvanizing is performed, which results in the occurrence of surface appearance defects, such as non-coating. Therefore, the Si content is set to be 0.80% or more and 2.00% or less.

Mn: 1.00% or More and 4.00% or Less

Mn is an element which stabilizes austenite and which is effective for achieving satisfactory strength of an annealed steel sheet. To achieve such strength, the Mn content is set to be 1.00% or more. However, in the case where the Mn content is more than 4.00%, since Mn forms a large amount of oxides on the surface of a steel sheet during annealing, there is a deterioration in wettability between the steel sheet and molten zinc when galvanizing is performed, which may result in surface appearance defects. Therefore, the Mn content is set to be 4.00% or less.

P: 0.100% or Less

P is an element which is effective for increasing the strength of steel. From the viewpoint of increasing the strength of steel, it is preferable that the P content be 0.001% or more. However, in the case where the P content is more than 0.100%, since embrittlement occurs due to grain boundary segregation, there is a deterioration in impact resistance. In addition, in the case where an alloying treatment is performed after a galvanizing treatment has been performed, an alloying reaction may be delayed. Therefore, the P content is set to be 0.100% or less.

S: 0.0100% or Less

S forms inclusions, such as MnS, which results in a deterioration in impact resistance and results in cracking occurring along a metal flow in a weld zone. Therefore, it is preferable that the S content be as small as possible, and, thereby, the S content is set to be 0.0100% or less.

Al: 0.100% or Less

In the case where the Al content is excessively large, there is a deterioration in surface quality and formability due to an increase in the amount of oxide-based inclusions. In addition, there is an increase in cost. Therefore, the Al content is set to be 0.100% or less. It is preferable that the Al content be 0.050% or less.

N: 0.0100% or Less

Since N is an element which deteriorates the aging resistance of steel, it is preferable that the N content be as small as possible. In the case where the N content is more than 0.0100%, there is a marked deterioration in aging resistance. Therefore, the N content is set to be 0.0100% or less.

Remainder is Fe and inevitable impurities. Here, the high-strength galvanized steel sheet according to the disclosed embodiments may contain the elements below as needed for the purpose of, for example, increasing strength.

Ti: 0.010% or More and 0.100% or Less

Ti is an element which contributes to increasing the strength of a steel sheet by combining with C or N to form fine carbides or fine nitrides in the steel sheet. To achieve such an effect, it is preferable that the Ti content be 0.010% or more. On the other hand, in the case where the Ti content is more than 0.100%, such an effect becomes saturated. Therefore, it is preferable that the Ti content be 0.100% or less.

Nb: 0.010% or More and 0.100% or Less

Nb is an element which contributes to increasing strength through solid solution strengthening or precipitation strengthening. To achieve such an effect, it is preferable that the Nb content be 0.010% or more. On the other hand, in the case where the Nb content is more than 0.100%, since there is a deterioration in the ductility of a steel sheet, there may be a deterioration in workability. Therefore, it is preferable that the Nb content be 0.100% or less.

B: 0.0001% or More and 0.0050% or Less

B is an element which contributes to increasing the strength of a steel sheet by improving hardenability. To achieve such an effect, it is preferable that the B content be 0.0001% or more. On the other hand, in the case where the B content is excessively large, since there is a deterioration in ductility, there may be a deterioration in workability. In addition, in the case where the B content is excessively large, there is also an increase in cost. Therefore, it is preferable that the B content be 0.0050% or less.

Mo: 0.01% or More and 0.50% or Less

Mo is an element which forms austenite and which is effective for achieving satisfactory strength of an annealed steel sheet. From the viewpoint of achieving satisfactory strength, it is preferable that the Mo content be 0.01% or more. However, since Mo incurs increased alloy costs, there is an increase in cost in the case where the Mo content is large. Therefore, it is preferable that the Mo content be 0.50% or less.

Cr: 0.60% or Less

Cr is an element which forms austenite and which is effective for achieving satisfactory strength of an annealed steel sheet. To achieve such effects, it is preferable that the Cr content be 0.01% or more. On the other hand, in the case where the Cr content is more than 0.60%, there may be a deterioration in the surface appearance of a coating layer due to oxides being formed on the surface of a steel sheet during annealing. Therefore, it is preferable that the Cr content be 0.60% or less.

Ni: 0.50% or Less, Cu: 1.00% or Less, and V: 0.500% or Less

Ni, Cu, and V are elements which are effective for increasing the strength of steel and which may be used to increase the strength of steel within the ranges according to the disclosed embodiments. To increase the strength of steel, it is preferable that the Ni content be 0.05% or more, that the Cu content be 0.05% or more, and that the V content be 0.005% or more. However, in the case where the Ni content is more than 0.50%, the Cu content is more than 1.00%, or the V content is more than 0.500% because of an excessive addition, there may be a deterioration in ductility due to a marked increase in strength. In addition, in the case where the contents of these elements are excessively large, there is also an increase in cost. Therefore, in the case where these elements are added, it is preferable that the Ni content be 0.50% or less, that the Cu content be 1.00% or less, and that the V content be 0.500% or less.

Sb: 0.10% or Less and Sn: 0.10% or Less

Sb and Sn have a function of inhibiting nitriding in the vicinity of the surface of a steel sheet. To inhibit nitriding, it is preferable that the Sb content be 0.005% or more and that the Sn content be 0.005% or more. However, in the case where the Sn content is more than 0.10% or the Sb content is more than 0.10%, the effect described above becomes saturated. Therefore, in the case where these elements are added, it is preferable that the Sb content be 0.10% or less and that the Sn content be 0.10% or less.

Ca: 0.0100% or Less

Ca is effective for improving ductility by controlling the shape of sulfides, such as MnS. To achieve such an effect, it is preferable that the Ca content be 0.0010% or more. However, in the case where the Ca content is more than 0.0100%, the effect described above becomes saturated. Therefore, in the case where Ca is added, it is preferable that the Ca content be 0.0100% or less.

REM: 0.010% or Less

REM contributes to improving workability by controlling the shape of sulfide-based inclusions. To achieve the effect of improving workability, it is preferable that the REM content be 0.001% or more. In addition, in the case where the REM content is more than 0.010%, since there is an increase in the amount of inclusions, there may be a deterioration in workability. Therefore, in the case where REM is added, it is preferable that the REM content be 0.010% or less.

Hereafter, the method for manufacturing the high-strength galvanized steel sheet according to the disclosed embodiments will be described.

A steel slab having the chemical composition described above is subjected to rough rolling and finish rolling in a hot rolling process, and cold rolling is performed after scale formed on the surface layer of the hot-rolled steel sheet has been removed in a pickling process. Here, there is no particular limitation on the conditions applied for the hot rolling process, the pickling process, or the cold rolling process, and the conditions may be appropriately determined. In addition, all or part of the hot rolling process may be omitted by using, for example, a thin-slab casting method.

Subsequently, the processes below, which relate to the important features of the disclosed embodiments, are performed.

A first heating process of heating a steel sheet to a temperature range of 800° C. or higher and 950° C. or lower in an atmosphere having a $H_2$ concentration of 0.05 vol % or more and 30.0 vol % or less and a dew point of 0° C. or lower, a first pickling process of pickling the steel sheet which has been subjected to the first heating process in an oxidizing acidic aqueous solution and of rinsing the pickled steel sheet in water, a second pickling process of pickling the steel sheet which has been subjected to the first pickling process in a non-oxidizing acidic aqueous solution and of rinsing the pickled steel sheet in water, a second heating process of holding the steel sheet which has been subjected to the second pickling process in a temperature range of 700° C. or higher and 900° C. or lower in an atmosphere having a $H_2$ concentration of 0.05 vol % or more and 30.0 vol % or less and a dew point of 0° C. or lower for 20 seconds or more and 300 seconds or less, and a process of performing a galvanizing treatment on the steel sheet which has been subjected to the second heating process are performed. Here, the processes described above may be performed in a continuous line, or a separate line may be used for each of the processes.

Hereafter, the processes will be described in detail.

First Heating Process

The first heating process is a process in which the steel sheet described above is heated to a temperature range of 800° C. or higher and 950° C. or lower in an atmosphere having a $H_2$ concentration of 0.05 vol % or more and 30.0 vol % or less and a dew point of 0° C. or lower. The first heating process is performed to form a microstructure including bainite as a main phase with austenite or martensite being included as part of the microstructure.

Since it is necessary that the $H_2$ concentration be sufficient for inhibiting oxidation of Fe, the $H_2$ concentration is set to be 0.05 vol % or more. On the other hand, in the case where the $H_2$ concentration is more than 30.0 vol %, there is an increase in cost. Therefore, the $H_2$ concentration is set to be 30.0 vol % or less. The remaining constituents of the atmosphere gas in the first heating process are $N_2$, $H_2O$, and inevitable impurities.

In addition, in the case where the dew point of the atmosphere in the first heating process is higher than 0° C., oxidation of Fe occurs. Therefore, it is necessary that the dew point be 0° C. or lower. Here, although there is no particular limitation on the lower limit of the dew point, it is preferable that the dew point be −60° C. or higher, because it is difficult to achieve a dew point of lower than −60° C. industrially.

In the case where the temperature of the steel sheet is lower than 800° C., since there is a decrease in the austenite phase fraction when the heat treatment is performed, C and Mn are inhomogeneously distributed in the microstructure, which may make it impossible to achieve an excellent strength-elongation balance due to an inhomogeneous microstructure being formed in the subsequent processes. On the other hand, in the case where the temperature of the steel sheet is higher than 950° C., there is an excessive increase in austenite grain diameter, which may finally make it impossible to achieve an excellent TS-El balance. Therefore, the heating temperature of the steel sheet to be held (steel sheet temperature) is set to be 800° C. or higher and 950° C. or lower. In the first heating process, the steel sheet may be held at a constant temperature, or the temperature may vary within the temperature range of 800° C. or higher and 950° C. or lower.

First Pickling Process

The surface of the steel sheet which has been subjected to the first heating process is pickled in an oxidizing acidic aqueous solution, and the pickled surface is rinsed in water. This first pickling process is performed for the purpose of cleaning the surface of the steel sheet, removing Si-based oxides, which have been formed on the surface of the steel sheet in the first heating process, and forming fine asperity on the surface of the steel sheet. Generally, since Si oxides have low solubility in acid, it takes a long time to completely dissolved and remove Si oxides. Therefore, using an oxidizing strong acid, such as nitric acid, as a pickling solution to remove Si oxides along with the base steel in the surface layer of the steel sheet is effective. At this time, since fine asperity is formed on the surface of the steel sheet as a result of the base steel being dissolved, there is an improvement in coating adhesiveness due to an anchor effect at the final coating interface. Examples of an oxidizing acidic aqueous solution include nitric acid, which is an oxidizing strong acid. Also, a mixture of nitric acid and at least one of hydrochloric acid, hydrofluoric acid, and sulfuric acid, which are non-oxidizing strong acids, may be used. In addition, in the case where an oxidizing acidic aqueous solution is used, it is preferable that the temperature be 20° C. to 70° C. and that the pickling time be 3 seconds to 30 seconds.

In addition, it is necessary to rapidly rinse the pickled steel sheet in water. In the case where rinsing in water is not performed, large amounts of Fe-based oxides and Fe-based hydroxides are inhomogeneously formed on the surface of the steel sheet due to the oxidizing power of the acidic solution remaining on the surface of the steel sheet, which may result in uneven surface appearance.

Second Pickling Process

The second pickling process is a process in which the surface of the steel sheet which has been subjected to the first pickling process is pickled again. This process is performed for the purpose of removing the Fe-based oxides and the Fe-based hydroxides, which have been formed on the surface of the steel sheet which has been subjected to the first pickling process, and of completely removing Si-based oxides, which may be remaining in a small amount on the surface of the steel sheet. Here, the Fe-based oxides and the Fe-based hydroxides are formed as a result of the base steel being oxidized by the pickling solution in the first pickling process. Therefore, it is necessary to use a non-oxidizing acidic aqueous solution in the second pickling process so that Fe-based oxides and Fe-based hydroxides are prevented from being formed again after the second pickling process has been performed. Examples of a preferable non-oxidizing acidic aqueous solution include a mixture of one, two, or more selected from hydrochloric acid, sulfuric acid, phosphoric acid, pyrophosphoric acid, formic acid, acetic acid, citric acid, hydrofluoric acid, and oxalic acid.

Here, regardless of the acids selected for the mixture described above, it is preferable that the temperature be 20° C. to 70° C. and that the pickling time be 1 second to 30 seconds.

In addition, it is necessary to rapidly rinse the pickled steel sheet in water. In the case where rinsing in water is not performed, the remaining pickling solution forms inhomogeneous asperity and corrosion products on the surface of the steel sheet, which may result in a deterioration in final surface appearance.

Second Heating Process

The steel sheet which has been subjected to the second pickling process is held in a temperature range of 700° C. or higher and 900° C. or lower in an atmosphere having a $H_2$ concentration of 0.05 vol % or more and 30.0 vol % or less and a dew point of 0° C. or lower for 20 seconds or more and 300 seconds or less. The second heating process is performed for the purpose of forming the final microstructure and activating the surface of the steel sheet before the steel sheet is subjected to a galvanizing treatment.

Since it is necessary that the $H_2$ concentration be sufficient for inhibiting oxidation of Fe, the $H_2$ concentration is set to be 0.05 vol % or more. In addition, in the case where the $H_2$ concentration is more than 30.0 vol %, there is an increase in cost. Therefore, the $H_2$ concentration is set to be 30.0 vol % or less. The remaining constituents are $N_2$, $H_2O$, and inevitable impurities.

In addition, in the case where the dew point is higher than 0° C., since Fe is hard to be reduced, it is not possible to clean the surface of the steel sheet before a galvanizing treatment is performed, which may result in a deterioration in coating wettability. Therefore, the dew point is set to be 0° C. or lower.

In the case where the steel sheet temperature is lower than 700° C., since there is an excessive increase in the amount of a ferrite phase during the heat treatment, there may be a case where it is not possible to achieve an excellent strength-elongation balance. Moreover, since the surface of the steel sheet is not sufficiently activated due to, for example, a natural oxide film on the surface of the steel sheet not being sufficiently reduced, there is a deterioration in wettability with molten zinc. On the other hand, in the case where the steel sheet temperature is higher than 900° C., since there is an excessive increase in the amount of an austenite phase during the heat treatment, there may be a case where it is not possible to achieve an excellent strength-elongation balance. Moreover, since a large amount of Si-based oxides is formed on the surface of the steel sheet during annealing, there is a deterioration in wettability between the steel sheet and molten zinc when a galvanizing treatment is performed. Therefore, the temperature at which the steel sheet is held in the second heating process is set to be 700° C. or higher and 900° C. or lower. Here, the holding temperature may remain constant or vary as long as the temperature is within the range described above.

In addition, in the case where the holding time is less than 20 seconds, since, for example, a natural oxide film on the surface of the steel sheet is not sufficiently reduced, there may be a case where the surface of the steel sheet is not sufficiently activated before a galvanizing treatment is performed. On the other hand, in the case where the holding time is more than 300 seconds, since a large amount of Si-based oxides are formed on the surface of the steel sheet, there is a deterioration in wettability between the steel sheet and molten zinc when a galvanizing treatment is performed. Therefore, the holding time is set to be 20 seconds or more and 300 seconds or less.

In addition, the steel sheet may be subjected to an oxidizing process and a reducing process as needed after the second pickling process and before the second heating process. Hereafter, the oxidizing process and the reducing process will be described.

Oxidizing Process

The oxidizing process is performed for the purpose of forming an Fe oxide film on the surface of the steel sheet to inhibit Si surface oxides and Mn surface oxides from being formed when reducing annealing is performed in the subsequent second heating process.

To oxidize Fe, it is preferable that the $O_2$ concentration be 0.1 vol % or more. On the other hand, it is preferable that the $O_2$ concentration be 20 vol % or less, which is the same level as the air, from the viewpoint of cost saving. In addition, to promote oxidation of Fe, it is preferable that the $H_2O$ concentration be 1 vol % or more. On the other hand, it is preferable that the $H_2O$ concentration be 50 vol % or less for economic reasons. Moreover, even in an atmosphere satisfying the requirements described above, Fe is not sufficiently oxidized in the case where the heating temperature, at which the steel sheet is heated, is lower than 400° C. On the other hand, in the case where the steel sheet temperature is higher than 900° C., since there is an excessive increase in the amount of Fe oxidized, a pickup defect of iron oxides occurs in rolls and unreduced Fe remains in the second heating process, which may result in a deterioration, rather than improvement, in surface appearance and coating adhesiveness after galvanizing treatment. Therefore, it is preferable that the steel sheet temperature be 400° C. or higher and 900° C. or lower.

Reducing Process

The reducing process is performed for the purpose of reducing the Fe oxide film, to such an extent that Fe oxide is not separated, to prevent the steel sheet which has been subjected to the oxidizing process from causing a pickup defect to occur in rolls in the second heating process.

To form reduced Fe, it is preferable that the $O_2$ concentration be less than 0.1 vol %. However, it is preferable that the $O_2$ concentration be 0.01 vol % or more. In addition, it is also preferable that the $H_2O$ concentration be 20 vol % or less to prevent oxidation of Fe. However, it is preferable that the $H_2O$ concentration be 1 vol % or more. In addition, reduced Fe is hard to be formed in the case where the steel sheet temperature is lower than 600° C., and there is an economic disadvantage due to an increase in heating costs in the case where the temperature is higher than 900° C. Therefore, it is preferable that the steel sheet temperature be 600° C. or higher and 900° C. or lower.

Process of Performing Galvanizing Treatment

The process of performing a galvanizing treatment is a process in which the steel sheet which has been subjected to the processes described above is cooled and dipped in a galvanizing bath to perform a galvanizing treatment.

To manufacture a galvanized steel sheet, it is preferable that a galvanizing bath having a temperature of 440° C. to 550° C. and an Al concentration in the bath of 0.13% to 0.24% be used.

In the case where the bath temperature is lower than 440° C., Zn may be solidified in a low-temperature zone which is formed due to a variation in temperature in the bath, which is inappropriate for a hot-dip plating bath. In the case where the bath temperature is higher than 550° C., since there is a significant vapor generation from the bath, the vaporized Zn adheres to the interior of the line, which may cause difficulties in operation. In addition, alloying progresses when galvanizing treatment is performed, which may result in an excessive increase in alloying degree.

In the case where the Al concentration in the bath is less than 0.13% when a galvanized steel sheet is manufactured, since there is an increase in the degree of Fe—Zn alloying, there may be a case of a deterioration in coating adhesiveness. In the case where the Al concentration is more than 0.24%, defects caused by Al oxides may occur.

In the case where an alloying treatment is performed after the galvanizing treatment has been performed, it is preferable that a galvanizing bath having an Al concentration of 0.10% to 0.20% be used. In the case where the Al concentration in the bath is less than 0.10%, since a large amount of F phase is formed, there may be a case of a deterioration in coating adhesiveness. In the case where the Al concentration is more than 0.20%, there may be a case where Fe—Zn alloying does not progress.

Alloying Treatment Process

The steel sheet which has been subjected to a galvanizing treatment process is further subjected to an alloying treatment as needed. Although there is no particular limitation on the conditions applied for the alloying treatment, it is preferable that the alloying treatment temperature be higher than 460° C. and lower than 600° C. In the case where the alloying temperature is 460° C. or lower, since alloying progresses at a low rate, it takes a long time to sufficiently perform alloying treatment, which results in a decrease in efficiency. In the case where the alloying temperature is 600° C. or higher, since there is an excessive increase in alloying degree, an excessive amount of hard and brittle Zn—Fe-alloy layer is formed at the base steel interface, which may result in a deterioration in coating adhesiveness.

EXAMPLES

Molten steels having the chemical compositions given in Table 1 with the balance being Fe and inevitable impurities were prepared and made into slabs. The obtained slabs were heated to a temperature of 1200° C., hot-rolled, and coiled. Subsequently, the obtained hot-rolled steel sheets were pickled and cold-rolled with a rolling reduction ratio of 50%. The obtained cold-rolled steel sheets were subjected to the first heating process, the first pickling process, the second pickling process, the second heating process, and the galvanizing treatment process under the conditions given in Table 2 and Table 3 in a furnace whose atmosphere was controllable. In the galvanizing treatment process, a galvanizing treatment was performed in a Zn bath having an Al concentration of 0.132%. In addition, some of the steel sheets were further subjected to an alloying treatment.

The tensile strength (TS), total elongation (EL), surface appearance, and coating adhesiveness (GI-adhesiveness and GA-adhesiveness) of the galvanized steel sheet (GI) and the galvannealed steel sheet (GA) obtained as described above were evaluated by using the methods described below.

<Tensile Strength and Total Elongation>

A tensile test was performed in accordance with JIS Z 2241 on a JIS No. 5 test piece which was taken from the steel sheet so that the tensile direction was perpendicular to the rolling direction to obtain TS (tensile strength) and total elongation (EL), and the level of elongation was evaluated in terms of the value of (TS)×(EL). In EXAMPLE, a case where (TS)×(EL) was 15000 MPa or more was determined as a case of good elongation.

<Surface Appearance>

Whether surface appearance defects, such as non-coating and a pinhole, existed was determined by performing visual observation. Evaluation was performed on the basis of the standard below, and a case of "B" or "C" was determined as preferable in the disclosed embodiments.

A: especially good without surface appearance defects
B: good almost without surface appearance defects
C: generally good with slight surface appearance defects
D: with surface appearance defects <Coating Adhesiveness>

The coating adhesiveness of the galvanized steel sheet (GI) was evaluated after having performed a ball impact test followed by a tape-peeling test on the worked portion. Whether coating layer separation occurred was determined by performing visual observation. The evaluation was performed on the basis of the standard below, and a case of "B" was determined as preferable. Here, the ball impact test was performed with a ball mass of 1.8 kg and a drop height of 100 cm.

B: No Coating Layer Separation, C: Slight Coating Layer Separation, D: Coating Layer Separation The coating adhesiveness of the galvannealed steel sheet (GA) was evaluated by performing a test for evaluating powdering resistance. Specifically, after having performed a 90-degree bending-unbending test on the surface of the galvannealed steel sheet to which a cellophane tape was applied, a cellophane tape having a width of 24 mm was pressed onto the inner side (compression side) of the worked portion so that the tape was parallel to the bending worked portion, and the pressed tape was peeled. The amount of zinc which adhered to a portion having a length of 40 mm of the peeled cellophane tape was determined in terms of Zn count number obtained by performing X-ray fluorescence spectrometry, and the determined Zn count was converted into that per unit length (1 m), which was used in the ranking on the basis of the standard below. In the disclosed embodiments, a case of rank 1 was determined as especially good (A), a case of rank 2 was determined as good (B), a case of rank 3 was determined as generally good (C), a case of rank 4 or more was determined as poor (D), and a case of "A", "B", or "C" was determined as preferable.

Fluorescent X-Ray Count Number and Corresponding Rank
0 or more and less than 2000: 1 (good)
2000 or more and less than 5000: 2
5000 or more and less than 8000: 3
8000 or more and less than 10000: 4
10000 or more: 5 (poor)

The evaluation results obtained as described above are given in Tables 2 through 5 along with the conditions.

TABLE 1

(mass %)

| Steel Grade Code | C | Si | Mn | P | S | Al | N | Ti | Nb | B | Mo |
|---|---|---|---|---|---|---|---|---|---|---|---|
| A | 0.136 | 1.56 | 2.15 | 0.006 | 0.0013 | 0.040 | 0.0035 | — | — | — | — |
| B | 0.177 | 1.91 | 2.24 | 0.003 | 0.0015 | 0.015 | 0.0029 | 0.021 | 0.035 | 0.0014 | — |

TABLE 1-continued

| | | | | | | | | | | | |
|---|---|---|---|---|---|---|---|---|---|---|---|
| C | 0.129 | 0.85 | 2.79 | 0.005 | 0.0013 | 0.033 | 0.0038 | 0.032 | — | — | — |
| D | 0.184 | 1.51 | 2.83 | 0.005 | 0.0012 | 0.032 | 0.0023 | 0.043 | 0.051 | — | 0.021 |
| E | 0.129 | 1.67 | 1.02 | 0.009 | 0.0010 | 0.034 | 0.0032 | 0.023 | 0.032 | — | — |
| F | 0.110 | 1.20 | 2.50 | 0.008 | 0.0012 | 0.021 | 0.0031 | — | — | — | — |
| G | 0.119 | 1.12 | 2.04 | 0.008 | 0.0010 | 0.028 | 0.0028 | — | — | — | — |
| H | 0.152 | 1.15 | 1.92 | 0.006 | 0.0011 | 0.025 | 0.0021 | — | — | — | — |
| I | 0.138 | 1.32 | 1.50 | 0.009 | 0.0010 | 0.032 | 0.0011 | — | — | — | — |
| J | 0.210 | 1.72 | 1.77 | 0.003 | 0.0010 | 0.015 | 0.0016 | — | — | — | — |
| K | 0.193 | 1.37 | 2.55 | 0.007 | 0.0012 | 0.029 | 0.0019 | — | — | — | — |
| L | 0.143 | 1.08 | 2.12 | 0.005 | 0.0013 | 0.024 | 0.0027 | — | — | — | — |
| M | 0.136 | 1.49 | 4.16 | 0.007 | 0.0009 | 0.021 | 0.0024 | 0.042 | 0.019 | — | — |
| N | 0.112 | 2.43 | 1.89 | 0.004 | 0.0008 | 0.028 | 0.0034 | 0.029 | 0.031 | 0.0012 | — |
| O | 0.114 | 0.70 | 1.89 | 0.004 | 0.0008 | 0.028 | 0.0034 | — | — | — | — |

(mass %)

| Steel Grade Code | Cr | Ni | Cu | V | Sb | Sn | Ca | REM | Note |
|---|---|---|---|---|---|---|---|---|---|
| A | — | — | — | — | — | — | — | — | Example Steel |
| B | — | — | — | — | — | — | — | — | Example Steel |
| C | — | — | — | — | — | — | — | — | Example Steel |
| D | — | — | — | — | — | — | — | — | Example Steel |
| E | 0.12 | — | — | — | — | — | — | — | Example Steel |
| F | — | — | 0.09 | — | — | — | — | — | Example Steel |
| G | — | 0.14 | | — | — | — | — | — | Example Steel |
| H | — | — | — | — | — | 0.03 | — | — | Example Steel |
| I | — | — | — | — | 0.06 | — | — | — | Example Steel |
| J | — | — | — | — | — | — | 0.004 | — | Example Steel |
| K | — | — | — | 0.0700 | — | — | — | — | Example Steel |
| L | — | — | — | — | — | — | — | 0.005 | Example Steel |
| M | — | — | — | — | — | — | — | — | Comparative Steel |
| N | — | — | — | — | — | — | — | — | Comparative Steel |
| O | — | — | — | — | — | — | — | — | Comparative Steel |

TABLE 2

| | | First Heating Process | | | | | | | Oxidizing Process | | | Reducing Process | | |
|---|---|---|---|---|---|---|---|---|---|---|---|---|---|---|
| | | | | | First Pickling Process | | Second Pickling Process | | | | | | | |
| No | Steel | $H_2$ (%) | Dew point (° C.) | Heating Temperature (° C.) | Pickling Solution | Pickling Time (s) | Pickling Solution | Pickling Time (s) | $O_2$ (%) | $H_2O$ (%) | Heating Temperature (° C.) | $O_2$ (%) | $H_2O$ (%) | Heating Temperature (° C.) |
| 1 | A | 10.0 | −35 | 860 | 120 g/L Nitric Acid + 20 g/L Hydrochloric Acid | 10.0 | 25 g/L Hydrochloric Acid | 5.0 | — | — | — | — | — | — |
| 2 | A | 10.0 | −35 | 860 | 120 g/L Nitric Acid + 20 g/L Hydrochloric Acid | 10.0 | 25 g/L Hydrochloric Acid | 5.0 | — | — | — | — | — | — |
| 3 | A | 25.0 | −30 | 860 | 120 g/L Nitric Acid + 20 g/L Hydrochloric Acid | 10.0 | 25 g/L Hydrochloric Acid | 5.0 | — | — | — | — | — | — |
| 4 | A | 0.1 | −30 | 860 | 120 g/L Nitric Acid + 20 g/L Hydrochloric Acid | 10.0 | 25 g/L Hydrochloric Acid | 5.0 | — | — | — | — | — | — |
| 5 | A | 10.0 | 0 | 860 | 120 g/L Nitric Acid + 20 g/L Hydrochloric Acid | 10.0 | 25 g/L Hydrochloric Acid | 5.0 | — | — | — | — | — | — |
| 6 | A | 10.0 | −45 | 860 | 120 g/L Nitric Acid + 20 g/L Hydrochloric Acid | 10.0 | 25 g/L Hydrochloric Acid | 5.0 | — | — | — | — | — | — |

TABLE 2-continued

| | | | | | | | | | | | | | | |
|---|---|---|---|---|---|---|---|---|---|---|---|---|---|---|
| 7 | A | 10.0 | −35 | 950 | 120 g/L Nitric Acid + 20 g/L Hydrochloric Acid | 10.0 | 25 g/L Hydrochloric Acid | 5.0 | — | — | — | — | — | — |
| 8 | A | 10.0 | −35 | 800 | 120 g/L Nitric Acid + 20 g/L Hydrochloric Acid | 10.0 | 25 g/L Hydrochloric Acid | 5.0 | — | — | — | — | — | — |
| 9 | A | 10.0 | −35 | 860 | 150 g/L Nitric Acid | 10.0 | 25 g/L Hydrochloric Acid | 5.0 | — | — | — | — | — | — |
| 10 | A | 10.0 | −35 | 860 | 150 g/L Nitric Acid + 20 g/L Hydrofluoric Acid | 10.0 | 25 g/L Hydrochloric Acid | 5.0 | — | — | — | — | — | — |
| 11 | A | 10.0 | −35 | 860 | 120 g/L Nitric Acid + 20 g/L Hydrochloric Acid | 10.0 | 30 g/L Sulfuric Acid | 5.0 | — | — | — | — | — | — |
| 12 | A | 10.0 | −30 | 860 | 120 g/L Nitric Acid + 20 g/L Hydrochloric Acid | 10.0 | 25 g/L Hydrofluoric Acid | 5.0 | — | — | — | — | — | — |
| 13 | A | 10.0 | −30 | 860 | 120 g/L Nitric Acid + 20 g/L Hydrochloric Acid | 10.0 | 25 g/L Hydrochloric Acid | 5.0 | — | — | — | — | — | — |
| 14 | A | 10.0 | −30 | 860 | 120 g/L Nitric Acid + 20 g/L Hydrochloric Acid | 10.0 | 25 g/L Hydrochloric Acid | 5.0 | — | — | — | — | — | — |
| 15 | A | 10.0 | −30 | 860 | 120 g/L Nitric Acid + 20 g/L Hydrochloric Acid | 10.0 | 25 g/L Hydrochloric Acid | 5.0 | — | — | — | — | — | — |
| 16 | A | 10.0 | −30 | 860 | 120 g/L Nitric Acid + 20 g/L Hydrochloric Acid | 10.0 | 25 g/L Hydrochloric Acid | 5.0 | — | — | — | — | — | — |
| 17 | A | 10.0 | −30 | 860 | 120 g/L Nitric Acid + 20 g/L Hydrochloric Acid | 10.0 | 25 g/L Hydrochloric Acid | 5.0 | — | — | — | — | — | — |
| 18 | A | 10.0 | −30 | 860 | 120 g/L Nitric Acid + 20 g/L Hydrochloric Acid | 10.0 | 25 g/L Hydrochloric Acid | 5.0 | — | — | — | — | — | — |
| 19 | B | 10.0 | −35 | 860 | 120 g/L Nitric Acid + 20 g/L Hydrochloric Acid | 10.0 | 25 g/L Hydrochloric Acid | 5.0 | — | — | — | — | — | — |
| 20 | B | 10.0 | −35 | 860 | 120 g/L Nitric Acid + 20 g/L Hydrochloric Acid | 10.0 | 25 g/L Hydrochloric Acid | 5.0 | — | — | — | — | — | — |
| 21 | B | 10.0 | −35 | 860 | 120 g/L Nitric Acid + 20 g/L Hydrochloric Acid | 10.0 | 25 g/L Hydrochloric Acid | 5.0 | — | — | — | — | — | — |
| 22 | B | 10.0 | −40 | 860 | 120 g/L Nitric Acid + 20 g/L Hydrochloric Acid | 10.0 | 25 g/L Hydrochloric Acid | 5.0 | — | — | — | — | — | — |

TABLE 2-continued

| | | | | | | | | | | | | | | |
|---|---|---|---|---|---|---|---|---|---|---|---|---|---|---|
| 23 | B | 0.1 | −40 | 860 | 120 g/L Nitric Acid + 20 g/L Hydrochloric Acid | 10.0 | 25 g/L Hydrochloric Acid | 5.0 | — | — | — | — | — | — |
| 24 | B | 10.0 | −5 | 860 | 120 g/L Nitric Acid + 20 g/L Hydrochloric Acid | 10.0 | 25 g/L Hydrochloric Acid | 5.0 | — | — | — | — | — | — |
| 25 | B | 10.0 | −35 | 860 | 120 g/L Nitric Acid + 20 g/L Hydrochloric Acid | 10.0 | 25 g/L Hydrochloric Acid | 5.0 | — | — | — | — | — | — |
| 26 | B | 10.0 | −35 | 860 | 120 g/L Nitric Acid + 20 g/L Hydrochloric Acid | 10.0 | 25 g/L Hydrochloric Acid | 5.0 | — | — | — | — | — | — |
| 27 | B | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 28 | B | 10.0 | −40 | 860 | 150 g/L Nitric Acid | 10.0 | 25 g/L Hydrochloric Acid | 5.0 | — | — | — | — | — | — |
| 29 | B | 10.0 | −40 | 860 | 150 g/L Nitric Acid + 30 g/L Sulfuric Acid | 10.0 | 25 g/L Hydrochloric Acid | 5.0 | — | — | — | — | — | — |
| 30 | B | 10.0 | −40 | 860 | 120 g/L Nitric Acid + 20 g/L Hydrochloric Acid | 10.0 | 30 g/L Sulfuric Acid | 5.0 | — | — | — | — | — | — |
| 31 | B | 10.0 | −35 | 950 | 120 g/L Nitric Acid + 20 g/L Hydrochloric Acid | 10.0 | 25 g/L Hydrochloric Acid | 5.0 | — | — | — | — | — | — |
| 32 | B | 10.0 | −35 | 800 | 120 g/L Nitric Acid + 20 g/L Hydrochloric Acid | 10.0 | 25 g/L Hydrochloric Acid | 5.0 | — | — | — | — | — | — |
| 33 | B | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 34 | C | 10.0 | −10 | 860 | 120 g/L Nitric Acid + 20 g/L Hydrochloric Acid | 10.0 | 25 g/L Hydrochloric Acid | 5.0 | — | — | — | — | — | — |
| 35 | C | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 36 | C | 0.1 | −40 | 860 | 120 g/L Nitric Acid + 20 g/L Hydrochloric Acid | 10.0 | 25 g/L Hydrochloric Acid | 5.0 | — | — | — | — | — | — |
| 37 | C | 10.0 | −40 | 860 | 150 g/L Nitric Acid | 10.0 | 25 g/L Hydrochloric Acid | 5.0 | — | — | — | — | — | — |
| 38 | C | 10.0 | −40 | 950 | 120 g/L Nitric Acid + 20 g/L Hydrochloric Acid | 10.0 | 25 g/L Hydrochloric Acid | 5.0 | — | — | — | — | — | — |
| 39 | C | 10.0 | −40 | 800 | 120 g/L Nitric Acid + 20 g/L | 10.0 | 25 g/L Hydrochloric Acid | 5.0 | — | — | — | — | — | — |

TABLE 2-continued

| | | | | | | | | | | | | | | |
|---|---|---|---|---|---|---|---|---|---|---|---|---|---|---|
| | | | | | Hydrochloric Acid | | | | | | | | | |
| 40 | C | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 41 | C | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 42 | C | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 43 | C | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 44 | C | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 45 | C | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 46 | D | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 47 | D | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 48 | D | 0.1 | −40 | 860 | 120 g/L Nitric Acid + 20 g/L Hydrochloric Acid | 10.0 | 25 g/L Hydrochloric Acid | 5.0 | — | — | — | — | — | — |
| 49 | D | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 50 | E | 10.0 | −40 | 860 | 120 g/L Nitric Acid +20 g/L Hydrochloric Acid | 10.0 | 25 g/L Hydrochloric Acid | 5.0 | — | — | — | — | — | — |
| 51 | E | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 52 | E | 10.0 | −40 | 950 | 120 g/L Nitric Acid + 20 g/L Hydrochloric Acid | 10.0 | 25 g/L Hydrochloric Acid | 5.0 | — | — | — | — | — | — |
| 53 | F | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 54 | F | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 55 | G | 10.0 | −40 | 860 | 120 g/L Nitric Acid + 20 g/L | 10.0 | 25 g/L Hydrochloric Acid | 5.0 | — | — | — | — | — | — |

TABLE 2-continued

| | | | | | | | | | | | | | | |
|---|---|---|---|---|---|---|---|---|---|---|---|---|---|---|
| | | | | | Hydrochloric Acid | | | | | | | | | |
| 56 | G | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 57 | H | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 58 | I | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 59 | J | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 60 | K | 10.0 | −40 | 860 | 120 g/L Nitric Acid + 20 g/L Hydrochloric Acid | 10.0 | 25 g/L Hydrochloric Acid | 5.0 | — | — | — | — | — | — |
| 61 | L | 10.0 | −40 | 860 | 120 g/L Nitric Acid + 20 g/L Hydrochloric Acid | 10.0 | 25 g/L Hydrochloric Acid | 5.0 | — | — | — | — | — | — |

| | | Second Heating Process | | | | Alloying Treatment | | | | | | |
|---|---|---|---|---|---|---|---|---|---|---|---|---|
| No | Steel | $H_2$ (%) | Dew point (° C.) | Heating Temperature (° C.) | Holding Time (s) | Process Alloying Temperature (° C.) | TS × EL (MPa · %) | Ra after Coating Separation (μm) | Surface Appearance | GI Adhesiveness | GA Adhesiveness | Note |
| 1 | A | 10.0 | −40 | 800 | 150 | — | 15150 | 1.0 | B | C | — | Example |
| 2 | A | 10.0 | −40 | 800 | 150 | 560 | 15150 | 0.8 | B | — | B | Example |
| 3 | A | 10.0 | −35 | 800 | 150 | 560 | 16891 | 1.1 | B | — | B | Example |
| 4 | A | 10.0 | −35 | 800 | 150 | 560 | 20755 | 0.6 | B | — | B | Example |
| 5 | A | 10.0 | −35 | 800 | 150 | 560 | 17160 | 0.9 | B | — | B | Example |
| 6 | A | 10.0 | −35 | 800 | 150 | 560 | 17723 | 0.8 | B | — | B | Example |
| 7 | A | 10.0 | −35 | 800 | 150 | 560 | 19110 | 1.0 | B | — | B | Example |
| 8 | A | 10.0 | −35 | 800 | 150 | 560 | 18514 | 0.6 | B | — | B | Example |
| 9 | A | 10.0 | −35 | 800 | 150 | 560 | 21124 | 0.9 | B | — | B | Example |
| 10 | A | 10.0 | −35 | 800 | 150 | 560 | 17328 | 0.8 | B | — | B | Example |
| 11 | A | 10.0 | −40 | 820 | 150 | 560 | 17398 | 1.7 | B | — | B | Example |
| 12 | A | 10.0 | −35 | 800 | 150 | 560 | 19572 | 0.6 | B | — | B | Example |
| 13 | A | 0.05 | −35 | 800 | 150 | 566 | 20641 | 1.4 | B | — | B | Example |
| 14 | A | 27.0 | −35 | 800 | 150 | 560 | 15283 | 1.1 | B | — | B | Example |
| 15 | A | 10.0 | −35 | 700 | 150 | 560 | 19145 | 0.8 | A | — | B | Example |
| 16 | A | 10.0 | −35 | 900 | 150 | 560 | 17030 | 1.5 | B | — | B | Example |
| 17 | A | 10.0 | −3 | 800 | 150 | 560 | 17159 | 1.7 | B | — | B | Example |
| 18 | A | 10.0 | −50 | 800 | 150 | 560 | 19296 | 1.1 | A | — | A | Example |
| 19 | B | 10.0 | −30 | 760 | 25 | — | 21150 | 0.6 | B | B | — | Example |
| 20 | B | 10.0 | −30 | 760 | 150 | — | 21037 | 1.0 | B | B | — | Example |
| 21 | B | 10.0 | −30 | 760 | 300 | — | 20221 | 1.4 | C | C | — | Example |
| 22 | B | 10.0 | −30 | 760 | 150 | — | 21278 | 1.4 | B | B | — | Example |
| 23 | B | 10.0 | −30 | 760 | 150 | — | 19758 | 0.6 | C | B | — | Example |
| 24 | B | 10.0 | −30 | 760 | 150 | — | 19254 | 1.9 | B | B | — | Example |
| 25 | B | 10.0 | −30 | 900 | 150 | — | 16812 | 0.6 | C | C | — | Example |
| 26 | B | 10.0 | −30 | 720 | 150 | — | 15772 | 1.7 | C | C | — | Example |
| 27 | B | 10.0 | −10 | 820 | 150 | 530 | 18364 | 1.9 | A | — | B | Example |
| 28 | B | 10.0 | −30 | 760 | 150 | — | 18981 | 1.1 | B | B | — | Example |
| 29 | B | 10.0 | −30 | 760 | 150 | — | 21290 | 1.5 | B | B | — | Example |
| 30 | B | 10.0 | −30 | 760 | 150 | — | 16115 | 0.8 | B | B | — | Example |
| 31 | B | 10.0 | −30 | 760 | 150 | — | 15391 | 0.9 | B | B | — | Example |
| 32 | B | 10.0 | −30 | 760 | 150 | — | 15527 | 1.1 | B | B | — | Example |
| 33 | B | 0.1 | −30 | 760 | 150 | — | 20991 | 1.4 | B | B | — | Example |
| 34 | C | 10.0 | −35 | 810 | 150 | 550 | 18340 | 1.5 | B | — | B | Example |
| 35 | C | 10.0 | −35 | 810 | 150 | 550 | 20806 | 0.7 | B | — | B | Example |
| 36 | C | 10.0 | −35 | 810 | 150 | 550 | 15613 | 0.9 | B | — | B | Example |
| 37 | C | 10.0 | −35 | 810 | 150 | 550 | 17848 | 1.6 | B | — | B | Example |
| 38 | C | 10.0 | −35 | 810 | 150 | 550 | 20914 | 1.3 | B | — | B | Example |
| 39 | C | 10.0 | −35 | 810 | 150 | 550 | 16567 | 0.8 | B | — | B | Example |

TABLE 2-continued

| | | | | | | | | | | | | |
|---|---|---|---|---|---|---|---|---|---|---|---|---|
| 40 | C | 10.0 | −45 | 810 | 150 | — | 18173 | 1.1 | A | A | — | Example |
| 41 | C | 10.0 | −20 | 800 | 150 | — | 15573 | 1.5 | B | B | — | Example |
| 42 | C | 10.0 | −40 | 820 | 300 | 550 | 19031 | 0.7 | C | — | B | Example |
| 43 | C | 0.1 | −35 | 810 | 150 | — | 21481 | 1.8 | B | B | — | Example |
| 44 | C | 10.0 | −35 | 700 | 150 | 550 | 19911 | 1.4 | B | — | C | Example |
| 45 | C | 10.0 | −35 | 900 | 150 | 550 | 18810 | 1.7 | B | — | B | Example |
| 46 | D | 10.0 | −40 | 800 | 150 | — | 19262 | 1.1 | B | B | — | Example |
| 47 | D | 10.0 | −20 | 820 | 150 | 530 | 18467 | 1.7 | B | — | A | Example |
| 48 | D | 10.0 | −40 | 800 | 150 | — | 18116 | 1.2 | C | B | — | Example |
| 49 | D | 10.0 | −45 | 820 | 150 | 530 | 20527 | 1.1 | B | — | A | Example |
| 50 | E | 10.0 | −40 | 800 | 150 | — | 20640 | 1.4 | C | — | — | Example |
| 51 | E | 10.0 | −50 | 800 | 150 | 550 | 16861 | 1.2 | A | — | B | Example |
| 52 | E | 10.0 | −40 | 800 | 150 | 550 | 16754 | 1.6 | B | — | B | Example |
| 53 | F | 10.0 | −40 | 820 | 150 | 520 | 18759 | 1.6 | B | — | B | Example |
| 54 | F | 10.0 | −45 | 820 | 150 | 520 | 19550 | 1.9 | A | — | B | Example |
| 55 | G | 10.0 | −40 | 850 | 150 | 550 | 15461 | 1.4 | B | — | B | Example |
| 56 | G | 10.0 | −5 | 850 | 150 | 550 | 17784 | 1.2 | B | — | B | Example |
| 57 | H | 10.0 | −40 | 820 | 150 | 560 | 20815 | 1.1 | B | — | B | Example |
| 58 | I | 10.0 | −40 | 850 | 150 | — | 21254 | 0.6 | B | B | — | Example |
| 59 | J | 10.0 | −40 | 850 | 150 | — | 16210 | 1.7 | C | C | — | Example |
| 60 | K | 10.0 | −40 | 850 | 150 | — | 21252 | 0.8 | B | B | — | Example |
| 61 | L | 10.0 | −40 | 850 | 150 | — | 21458 | 1.3 | B | B | — | Example |

TABLE 3

| | | First Heating Process | | | | | | | Oxidizing Process | | | Reducing Process | | |
|---|---|---|---|---|---|---|---|---|---|---|---|---|---|---|
| | | | | | First Pickling Process | | Second Pickling Precess | | | | | | | |
| No | Steel | $H_2$ (%) | Dew point (° C.) | Heating Temperature (° C.) | Pickling Solution | Pickling Time (s) | Pickling Solution | Pickling Time (s) | $O_2$ (%) | $H_2O$ (%) | Heating Temperature (° C.) | $O_2$ (%) | $H_2O$ (%) | Heating Temperature (° C.) |
| 62 | A | 10.0 | −35 | 860 | 120 g/L Nitric Acid + 20 g/L Hydrochloric Acid | 10.0 | 25 g/L Hydrochloric Acid | 5.0 | — | — | — | — | — | — |
| 63 | A | 0.01 | −35 | 860 | 120 g/L Nitric Acid + 20 g/L Hydrochloric Acid | 10.0 | 25 g/L Hydrochloric Acid | 5.0 | — | — | — | — | — | — |
| 64 | A | 10.0 | 5 | 860 | 120 g/L Nitric Acid + 20 g/L Hydrochloric Acid | 10.0 | 25 g/L Hydrochloric Acid | 5.0 | — | — | — | — | — | — |
| 65 | A | 10.0 | −35 | 860 | 120 g/L Nitric Acid + 20 g/L Hydrochloric Acid | 10.0 | 25 g/L Hydrochloric Acid | 5.0 | — | — | — | — | — | — |
| 66 | A | 10.0 | −35 | 860 | 120 g/L Nitric Acid + 20 g/L Hydrochloric Acid | 10.0 | 25 g/L Hydrochloric Acid | 5.0 | — | — | — | — | — | — |
| 67 | A | 10.0 | −35 | 860 | 120 g/L Nitric Acid + 20 g/L Hydrochloric Acid | 10.0 | 25 g/L Hydrochloric Acid | 5.0 | — | — | — | — | — | — |
| 68 | A | 10.0 | −35 | 850 | — | — | — | — | — | — | — | — | — | — |
| 69 | A | 10.0 | −40 | 750 | 120 g/L Nitric Acid + 20 g/L Hydrochloric Acid | 10.0 | 25 g/L Hydrochloric Acid | 5.0 | — | — | — | — | — | — |
| 70 | A | 10.0 | −30 | 980 | 140 g/L Hydrochloric Acid | 10.0 | 25 g/L Hydrochloric Acid | 5.0 | — | — | — | — | — | — |
| 71 | A | 10.0 | −30 | 860 | 140 g/L Hydrochloric Acid | 10.0 | 25 g/L Hydrochloric Acid | 5.0 | — | — | — | — | — | — |

TABLE 3-continued

| | | | | | | | | | | | | | | |
|---|---|---|---|---|---|---|---|---|---|---|---|---|---|---|
| 72 | B | 10.0 | −30 | 850 | 120 g/L Nitric Acid + 20 g/L Hydrochloric Acid | 10.0 | 25 g/L Nitric Acid | 5.0 | — | — | — | — | — | — |
| 73 | B | 10.0 | −30 | 850 | 120 g/L Nitric Acid + 20 g/L Hydrochloric Acid | 10.0 | — | — | — | — | — | — | — | — |
| 74 | M | 10.0 | −40 | 850 | 120 g/L Nitric Acid + 20 g/L Hydrochloric Acid | 10.0 | 25 g/L Hydrochloric Acid | 5.0 | — | — | — | — | — | — |
| 75 | N | 10.0 | −40 | 850 | 120 g/L Nitric Acid + 20 g/L Hydrochloric Acid | 10.0 | 25 g/L Hydrochloric Acid | 5.0 | — | — | — | — | — | — |
| 76 | O | 10.0 | −40 | 850 | 120 g/L Nitric Acid + 20 g/L Hydrochloric Acid | 10.0 | 25 g/L Hydrochloric Acid | 5.0 | — | — | — | — | — | — |

| | | Second Heating Process | | | | Alloying Treatment | | | | | | |
|---|---|---|---|---|---|---|---|---|---|---|---|---|
| No | Steel | $H_2$ (%) | Dew point (° C.) | Heating Temperature (° C.) | Holding Time (s) | Process Alloying Temperature (° C.) | TS × EL (MPa · %) | Ra after Coating Separation (μm) | Surface Appearance | GI Adhesiveness | GA Adhesiveness | Note |
| 62 | A | 15.0 | −40 | 950 | 150 | 560 | 14200 | 1.1 | D | — | D | Comparative Example |
| 63 | A | 15.0 | −40 | 800 | 150 | 560 | 17294 | 1.2 | B | — | D | Comparative Example |
| 64 | A | 15.0 | −40 | 800 | 150 | 560 | 17664 | 0.7 | D | — | D | Comparative Example |
| 65 | A | 0.01 | −40 | 800 | 150 | 560 | 16006 | 1.1 | D | — | D | Comparative Example |
| 66 | A | 15.0 | 10 | 800 | 150 | 560 | 16405 | 1.5 | D | — | D | Comparative Example |
| 67 | A | 15.0 | −40 | 650 | 150 | 560 | 13850 | 1.5 | D | — | D | Comparative Example |
| 68 | A | 15.0 | −30 | 800 | 160 | 530 | 16031 | 0.2 | D | — | D | Comparative Example |
| 69 | A | 10.0 | −40 | 800 | 150 | — | 14050 | 1.3 | A | B | — | Comparative Example |
| 70 | A | 10.0 | −35 | 850 | 180 | 560 | 12950 | 0.5 | D | — | D | Comparative Example |
| 71 | A | 10.0 | −35 | 850 | 180 | 560 | 15987 | 0.5 | D | — | D | Comparative Example |
| 72 | B | 15.0 | −45 | 850 | 160 | — | 18246 | 2.3 | B | D | — | Comparative Example |
| 73 | B | 15.0 | −45 | 850 | 160 | — | 16843 | 0.8 | C | D | — | Comparative Example |
| 74 | M | 15.0 | −40 | 820 | 160 | — | 17975 | 1.1 | D | D | — | Comparative Example |
| 75 | N | 15.0 | −35 | 820 | 160 | — | 21629 | 0.9 | D | B | — | Comparative Example |
| 76 | O | 15.0 | −35 | 820 | 160 | 530 | 13200 | 1.9 | B | — | B | Comparative Example |

TABLE 4

| | | First Heating Process | | | First Pickling Process | | Second Pickling Precess | | Oxidizing Process | | | Reducing Process | | |
|---|---|---|---|---|---|---|---|---|---|---|---|---|---|---|
| No | Steel | $H_2$ (%) | Dew point (° C.) | Heating Temperature (° C.) | Pickling Solution | Pickling Time (s) | Pickling Solution | Pickling Time (s) | $O_2$ (%) | $H_2O$ (%) | Heating Temperature (° C.) | $O_2$ (%) | $H_2O$ (%) | Heating Temperature (° C.) |
| 77 | A | 10.0 | −40 | 850 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 78 | A | 10.0 | −30 | 860 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 79 | A | 28.0 | −30 | 860 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 80 | A | 0.07 | −30 | 860 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 81 | A | 10.0 | 0 | 860 | 120 g/L Nitric Acid + 20 g/L Hydrochloric Acid | 10.0 | 25 g/L Hydrochloric Acid | 5.0 | 1.0 | 15 | 650 | 0.01 | 5.0 | 750 |
| 82 | A | 10.0 | −45 | 860 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 83 | A | 10.0 | −35 | 950 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 84 | A | 10.0 | −35 | 800 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 85 | A | 10.0 | −35 | 860 | 150 g/L Nitric Acid | 10.0 | 25 g/L Hydrochloric Acid | 5.0 | 1.0 | 15 | 700 | 0.01 | 5.0 | 750 |
| 86 | A | 10.0 | −35 | 860 | 120 g/L Nitric Acid + 20 g/L Hydrochloric Acid | 10.0 | 30 g/L Sulfuric Acid | 5.0 | 1.0 | 15 | 650 | 0.01 | 5.0 | 700 |
| 87 | A | 10.0 | −30 | 860 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 88 | A | 10.0 | −30 | 860 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 89 | A | 10.0 | −30 | 860 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 90 | A | 10.0 | −30 | 860 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 91 | A | 10.0 | −30 | 860 | 120 g/L Nitric Acid + 20 g/L | 10.0 | 25 g/L Hydrochloric Acid | 5.0 | 1.0 | 15 | 700 | 0.01 | 5.0 | 750 |

TABLE 4-continued

| | | | | | | | | | | | | | | |
|---|---|---|---|---|---|---|---|---|---|---|---|---|---|---|
| | | | | | Hydrochloric Acid | | | | | | | | | |
| 92 | A | 10.0 | −30 | 860 | 120 g/L Nitric Acid + 20 g/L Hydrochloric Acid | 10.0 | 25 g/L Hydrochloric Acid | 5.0 | 20.0 | 15 | 700 | 0.01 | 5.0 | 750 |
| 93 | A | 10.0 | −30 | 860 | 120 g/L Nitric Acid + 20 g/L Hydrochloric Acid | 10.0 | 25 g/L Hydrochloric Acid | 5.0 | 0.1 | 15 | 700 | 0.01 | 5.0 | 750 |
| 94 | A | 10.0 | −30 | 860 | 120 g/L Nitric Acid + 20 g/L Hydrochloric Acid | 10.0 | 25 g/L Hydrochloric Acid | 5.0 | 1.0 | 50 | 700 | 0.01 | 5.0 | 750 |
| 95 | A | 10.0 | −30 | 860 | 120 g/L Nitric Acid + 20 g/L Hydrochloric Acid | 10.0 | 25 g/L Hydrochloric Acid | 5.0 | 1.0 | 1.0 | 700 | 0.01 | 5.0 | 750 |
| 96 | A | 10.0 | −30 | 860 | 120 g/L Nitric Acid + 20 g/L Hydrochloric Acid | 10.0 | 25 g/L Hydrochloric Acid | 5.0 | 1.0 | 15 | 400 | 0.01 | 5.0 | 750 |
| 97 | A | 10.0 | −30 | 860 | 120 g/L Nitric Acid + 20 g/L Hydrochloric Acid | 10.0 | 25 g/L Hydrochloric Acid | 5.0 | 1.0 | 15 | 880 | 0.01 | 5.0 | 750 |
| 98 | A | 10.0 | −30 | 860 | 120 g/L Nitric Acid + 20 g/L Hydrochloric Acid | 10.0 | 25 g/L Hydrochloric Acid | 5.0 | 1.0 | 15 | 700 | 0.08 | 5.0 | 750 |
| 99 | A | 10.0 | −30 | 860 | 120 g/L Nitric Acid + 20 g/L Hydrochloric Acid | 10.0 | 25 g/L Hydrochloric Acid | 5.0 | 1.0 | 15 | 700 | 0.01 | 1.0 | 750 |
| 100 | A | 10.0 | −30 | 860 | 120 g/L Nitric Acid + 20 g/L Hydrochloric Acid | 10.0 | 25 g/L Hydrochloric Acid | 5.0 | 1.0 | 15 | 700 | 0.01 | 19.0 | 750 |
| 101 | A | 10.0 | −30 | 860 | 120 g/L Nitric Acid + 20 g/L Hydrochloric Acid | 10.0 | 25 g/L Hydrochloric Acid | 5.0 | 1.0 | 15 | 700 | 0.01 | 5.0 | 600 |
| 102 | A | 10.0 | −30 | 860 | 120 g/L Nitric Acid + 20 g/L Hydrochloric Acid | 10.0 | 25 g/L Hydrochloric Acid | 5.0 | 1.0 | 15 | 700 | 0.01 | 5.0 | 900 |
| 103 | B | 15.0 | −40 | 850 | 120 g/L Nitric Acid + 20 g/L Hydrochloric Acid | 10.0 | 25 g/L Hydrochloric Acid | 5.0 | 1.0 | 15 | 650 | — | — | — |
| 104 | B | 15.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 105 | B | 15.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 106 | B | 15.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 107 | B | 10.0 | −40 | 810 | 120 g/L Nitric Acid + 20 g/L | 10.0 | 25 g/L Hydrochloric Acid | 5.0 | 1.0 | 15 | 650 | 0.01 | 5.0 | 700 |

TABLE 4-continued

| | | | | | | | | | | | | | | |
|---|---|---|---|---|---|---|---|---|---|---|---|---|---|---|
| | | | | | Hydrochloric Acid | | | | | | | | | |
| 108 | C | 5.0 | −35 | 800 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 109 | C | 10.0 | −40 | 850 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 110 | C | 5.0 | −40 | 820 | 120 g/L Nitric Acid + 20 g/L Hydrochloric Acid | 10.0 | 25 g/L Hydrochloric Acid | 5.0 | 1.0 | 15 | 700 | 0.01 | 5.0 | 750 |
| 111 | C | 10.0 | −30 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 112 | D | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 113 | D | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 114 | E | 5.0 | −40 | 820 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 115 | E | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 116 | F | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 117 | G | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 118 | H | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 119 | I | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 120 | J | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 121 | K | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |
| 122 | L | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5.0 | 700 |

TABLE 4-continued

| No | Steel | Second Heating Process $H_2$ (%) | Dew point (° C.) | Heating Temperature (° C.) | Holding Time (s) | Alloying Treatment Process Alloying Temperature (° C.) | TS × EL (MPa · %) | Ra after Coating Separation (μm) | Surface Appearance | GI Adhesiveness | GA Adhesiveness | Note |
|---|---|---|---|---|---|---|---|---|---|---|---|---|
| 77 | A | 15.0 | −40 | 820 | 160 | — | 16408 | 1.2 | A | B | — | Example |
| 78 | A | 10.0 | −35 | 800 | 180 | 560 | 20611 | 1.5 | A | — | B | Example |
| 79 | A | 10.0 | −35 | 800 | 180 | 560 | 17178 | 0.7 | A | — | B | Example |
| 80 | A | 10.0 | −35 | 800 | 180 | 560 | 15108 | 1.5 | A | — | B | Example |
| 81 | A | 10.0 | −35 | 800 | 180 | 560 | 21792 | 1.1 | B | — | B | Example |
| 82 | A | 10.0 | −35 | 800 | 180 | 560 | 17279 | 1.7 | A | — | B | Example |
| 83 | A | 10.0 | −35 | 800 | 180 | 560 | 19839 | 1.6 | B | — | B | Example |
| 84 | A | 10.0 | −35 | 800 | 180 | 560 | 21470 | 1.5 | B | — | B | Example |
| 85 | A | 10.0 | −35 | 800 | 180 | 560 | 15776 | 1.9 | B | — | B | Example |
| 86 | A | 15.0 | −40 | 820 | 160 | 560 | 19893 | 1.3 | B | — | B | Example |
| 87 | A | 0.05 | −35 | 800 | 180 | 560 | 21568 | 1.4 | A | — | B | Example |
| 88 | A | 28.0 | −35 | 800 | 180 | 560 | 18206 | 1.2 | A | — | B | Example |
| 89 | A | 10.0 | −35 | 700 | 180 | 560 | 20811 | 1.5 | A | — | B | Example |
| 90 | A | 10.0 | −35 | 900 | 180 | 560 | 21004 | 0.6 | B | — | B | Example |
| 91 | A | 10.0 | −5 | 800 | 180 | 560 | 20684 | 1.6 | A | — | A | Example |
| 92 | A | 10.0 | −35 | 800 | 180 | 560 | 18338 | 1.9 | B | — | B | Example |
| 93 | A | 10.0 | −35 | 800 | 180 | 560 | 15427 | 1.8 | C | — | B | Example |
| 94 | A | 10.0 | −35 | 800 | 180 | 560 | 15524 | 1.6 | C | — | A | Example |
| 95 | A | 10.0 | −35 | 800 | 180 | 560 | 16359 | 0.8 | B | — | B | Example |
| 96 | A | 10.0 | −35 | 800 | 180 | 560 | 21345 | 1.0 | B | — | B | Example |
| 97 | A | 10.0 | −35 | 800 | 180 | 560 | 18337 | 1.6 | A | — | B | Example |
| 98 | A | 10.0 | −35 | 800 | 180 | 560 | 21180 | 1.2 | B | — | B | Example |
| 99 | A | 10.0 | −35 | 800 | 180 | 560 | 17700 | 1.5 | B | — | B | Example |
| 100 | A | 10.0 | −35 | 800 | 180 | 560 | 16941 | 1.5 | B | — | B | Example |
| 101 | A | 10.0 | −35 | 800 | 180 | 560 | 21590 | 0.7 | B | — | B | Example |
| 102 | A | 10.0 | −35 | 800 | 180 | 560 | 19414 | 1.6 | B | — | B | Example |
| 103 | B | 15.0 | −30 | 760 | 160 | — | 21922 | 1.5 | A | B | — | Example |
| 104 | B | 15.0 | −30 | 760 | 30 | — | 17061 | 0.8 | B | A | — | Example |
| 105 | B | 15.0 | −30 | 760 | 300 | — | 18615 | 0.6 | A | B | — | Example |
| 106 | B | 15.0 | −30 | 760 | 160 | — | 19524 | 1.4 | A | B | — | Example |
| 107 | B | 10.0 | −10 | 820 | 150 | 530 | 20730 | 1.3 | A | — | A | Example |
| 108 | C | 10.0 | −35 | 810 | 160 | 550 | 17258 | 1.4 | B | — | B | Example |
| 109 | C | 10.0 | −40 | 790 | 160 | — | 17767 | 1.8 | B | B | — | Example |
| 110 | C | 15.0 | −30 | 800 | 160 | — | 15680 | 1.2 | A | B | — | Example |
| 111 | C | 15.0 | −40 | 820 | 160 | 550 | 15999 | 1.6 | B | — | B | Example |
| 112 | D | 10.0 | −40 | 800 | 160 | — | 19588 | 1.5 | B | B | — | Example |
| 113 | D | 15.0 | −20 | 820 | 160 | 530 | 19782 | 1.9 | A | — | A | Example |
| 114 | E | 15.0 | −40 | 800 | 160 | — | 16949 | 1.6 | B | B | — | Example |
| 115 | E | 15.0 | −40 | 800 | 160 | 550 | 17313 | 1.6 | B | — | B | Example |
| 116 | F | 15.0 | −40 | 820 | 160 | 520 | 19195 | 0.8 | B | — | B | Example |
| 117 | G | 15.0 | −40 | 850 | 160 | 550 | 20288 | 0.8 | B | — | B | Example |
| 118 | H | 15.0 | −40 | 820 | 160 | 560 | 15549 | 1.2 | B | — | B | Example |
| 119 | I | 15.0 | −40 | 850 | 160 | — | 20889 | 1.3 | B | B | — | Example |
| 120 | J | 15.0 | −40 | 850 | 160 | — | 19894 | 1.7 | B | B | — | Example |
| 121 | K | 15.0 | −40 | 850 | 160 | — | 20842 | 1.8 | B | B | — | Example |
| 122 | L | 15.0 | −40 | 850 | 160 | — | 19060 | 1.6 | B | B | — | Example |

TABLE 5

| No | Steel | First Heating Process $H_2$ (%) | Dew point (° C.) | Heating Temperature (° C.) | First Pickling Process Pickling Solution | Pickling Time (s) | Second Pickling Process Pickling Solution | Pickling Time (s) | Oxidizing Process $O_2$ (%) | $H_2O$ (%) | Heating Temperature (° C.) | Reducing Process $O_2$ (%) | $H_2O$ (%) | Heating Temperature (° C.) |
|---|---|---|---|---|---|---|---|---|---|---|---|---|---|---|
| 123 | A | 10.0 | −35 | 860 | 120 g/L Nitric Acid + 20 g/L Hydrochloric Acid | 10.0 | 25 g/L Hydrochloric Acid | 5.0 | 1.0 | 15 | 650 | 0.01 | 5 | 700 |
| 124 | A | 0.01 | −35 | 860 | 120 g/L Nitric Acid + 20 g/L Hydrochloric Acid | 10.0 | 25 g/L Hydrochloric Acid | 5.0 | 1.0 | 15 | 650 | 0.01 | 5 | 700 |

TABLE 5-continued

| | | | | | | | | | | | | | | |
|---|---|---|---|---|---|---|---|---|---|---|---|---|---|---|
| 125 | A | 10.0 | 10 | 860 | 120 g/L Nitric Acid + 20 g/L Hydrochloric Acid | 10.0 | 25 g/L Hydrochloric Acid | 5.0 | 1.0 | 15 | 650 | 0.01 | 5 | 700 |
| 126 | A | 10.0 | −35 | 860 | 120 g/L Nitric Acid + 20 g/L Hydrochloric Acid | 10.0 | 25 g/L Hydrochloric Acid | 5.0 | 1.0 | 15 | 650 | 0.01 | 5 | 700 |
| 127 | A | 10.0 | −35 | 860 | 120 g/L Nitric Acid + 20 g/L Hydrochloric Acid | 10.0 | 25 g/L Hydrochloric Acid | 5.0 | 1.0 | 15 | 650 | 0.01 | 5 | 700 |
| 128 | A | 10.0 | −35 | 860 | 120 g/L Nitric Acid + 20 g/L Hydrochloric Acid | 10.0 | 25 g/L Hydrochloric Acid | 5.0 | 1.0 | 15 | 650 | 0.01 | 5 | 700 |
| 129 | A | 10.0 | −40 | 850 | — | — | — | — | 1.0 | 15 | 650 | 0.01 | 5 | 700 |
| 130 | A | 10.0 | −40 | 750 | 120 g/L Nitric Acid + 20 g/L Hydrochloric Acid | 10.0 | 25 g/L Hydrochloric Acid | 5.0 | 1.0 | 15 | 650 | 0.01 | 5 | 700 |
| 131 | A | 10.0 | −40 | 980 | 120 g/L Nitric Acid + 20 g/L Hydrochloric Acid | 10.0 | 25 g/L Hydrochloric Acid | 5.0 | 1.0 | 15 | 650 | 0.01 | 5 | 700 |
| 132 | A | 10.0 | −30 | 860 | 140 g/L Hydrochloric Acid | 10.0 | 25 g/L Hydrochloric Acid | 5.0 | 1.0 | 15 | 700 | 0.01 | 5 | 750 |
| 133 | B | 10.0 | −30 | 850 | 120 g/L Nitric Acid + 20 g/L Hydrochloric Acid | 10.0 | 25 g/L Nitric Acid | 5.0 | 1.0 | 15 | 700 | 0.01 | 5 | 750 |
| 134 | B | 10.0 | −30 | 850 | 120 g/L Nitric Acid + 20 g/L Hydrochloric Acid | 10.0 | — | — | 1.0 | 15 | 700 | 0.01 | 5 | 750 |
| 135 | M | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5 | 700 |
| 136 | N | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5 | 700 |
| 137 | O | 10.0 | −40 | 850 | 120 g/L Nitric Acid + 20 g/L Hydrochloric Acid | 10.0 | 25 g/L Hydrochloric Acid | 5.0 | 1.0 | 15 | 650 | 0.01 | 5 | 700 |

| | | Second Heating Process | | | | Alloying Treatment | | | | | | |
|---|---|---|---|---|---|---|---|---|---|---|---|---|
| No | Steel | $H_2$ (%) | Dew point (° C.) | Heating Temperature (° C.) | Holding Time (s) | Process Alloying Temperature (° C.) | TS × EL (MPa · %) | Ra after Coating Separation (μm) | Surface Appearance | GI Adhesiveness | GA Adhesiveness | Note |
| 123 | A | 15.0 | −40 | 950 | 150 | 560 | 13900 | 0.6 | D | — | D | Comparative Example |
| 124 | A | 15.0 | −40 | 800 | 150 | 560 | 16263 | 1.3 | C | — | D | Comparative Example |
| 125 | A | 15.0 | −40 | 800 | 150 | 560 | 20512 | 1.9 | D | — | D | Comparative Example |
| 126 | A | 0.01 | −40 | 800 | 150 | 560 | 16263 | 1.4 | D | — | D | Comparative Example |
| 127 | A | 15.0 | 10 | 800 | 150 | 560 | 16263 | 1.9 | D | — | D | Comparative Example |
| 128 | A | 15.0 | −40 | 680 | 150 | 560 | 14060 | 1.3 | D | — | D | Comparative Example |

TABLE 5-continued

| | | | | | | | | | | | | |
|---|---|---|---|---|---|---|---|---|---|---|---|---|
| 129 | A | 15.0 | −30 | 850 | 160 | 530 | 16660 | 0.2 | D | — | D | Comparative Example |
| 130 | A | 10.0 | −35 | 810 | 150 | — | 13800 | 1.9 | A | B | — | Comparative Example |
| 131 | A | 10.0 | −35 | 810 | 150 | — | 14190 | 1.9 | A | B | — | Comparative Example |
| 132 | A | 10.0 | −35 | 800 | 180 | 560 | 17200 | 0.5 | D | — | D | Comparative Example |
| 133 | B | 15.0 | −45 | 820 | 160 | — | 19846 | 2.3 | D | D | — | Comparative Example |
| 134 | B | 15.0 | −45 | 820 | 160 | — | 16895 | 0.8 | D | D | — | Comparative Example |
| 135 | M | 15.0 | −40 | 820 | 160 | — | 19806 | 1.5 | D | C | — | Comparative Example |
| 136 | N | 15.0 | −35 | 820 | 160 | — | 20970 | 1.8 | D | C | — | Comparative Example |
| 137 | O | 15.0 | −35 | 820 | 160 | 530 | 12100 | 0.6 | A | — | B | Comparative Example |

It is clarified that all the high-strength galvanized steel sheets of the examples were excellent in terms of elongation, surface appearance, and coating adhesiveness. In contrast, the comparative examples were poor in terms of at least one of elongation, surface appearance, and coating adhesiveness.

The invention claimed is:

1. A method for manufacturing a galvanized steel sheet, the method comprising:

a first heating process including heating a steel sheet to a temperature in a range of 800° C. or higher and 950° C. or lower in an atmosphere having a $H_2$ concentration of 0.05 vol % or more and 30.0 vol % or less and a dew point of 0° C. or lower, the steel sheet having a chemical composition comprising, by mass %:

C: 0.040% or more and 0.500% or less,
Si: 0.80% or more and 2.00% or less,
Mn: 1.00% or more and 4.00% or less,
P: 0.100% or less,
S: 0.0100% or less,
Al: 0.100% or less,
N: 0.0100% or less, and
a balance being Fe and inevitable impurities;

a first pickling process including: (i) pickling the steel sheet, which has been subjected to the first heating process, in an oxidizing acidic aqueous solution and (ii) rinsing the pickled steel sheet in water;

a second pickling process including: (i) pickling the steel sheet, which has been subjected to the first pickling process, in a non-oxidizing acidic aqueous solution and (ii) rinsing the pickled steel sheet in water;

a second heating process including holding the steel sheet, which has been subjected to the second pickling process, at a temperature in a range of 700° C. or higher and 900° C. or lower in an atmosphere having a $H_2$ concentration of 0.05 vol % or more and 30.0 vol % or less and a dew point of 0° C. or lower for 20 seconds or more and 300 seconds or less; and performing a galvanizing treatment on the steel sheet which has been subjected to the second heating process; and an oxidizing process including heating the steel sheet to a temperature in a range of 400° C. or higher and 900° C. or lower in an atmosphere having an $O_2$ concentration of 0.1 vol % or more and 20 vol % or less and a $H_2O$ concentration of 1 vol % or more and 50 vol % or less after the second pickling process and before the second heating process.

2. The method for manufacturing a galvanized steel sheet according to claim 1, wherein the chemical composition further comprises, by mass %, at least one selected from the group consisting of:

Ti: 0.010% or more and 0.100% or less,
Nb: 0.010% or more and 0.100% or less, and
B: 0.0001% or more and 0.0050% or less.

3. The method for manufacturing a galvanized steel sheet according to claim 2, wherein the chemical composition further comprises, by mass %, at least one selected from the group consisting of:

Mo: 0.01% or more and 0.50% or less,
Cr: 0.60% or less,
Ni: 0.50% or less,
Cu: 1.00% or less,
V: 0.500% or less,
Sb: 0.10% or less,
Sn: 0.10% or less,
Ca: 0.0100% or less, and
REM: 0.010% or less.

4. The method for manufacturing a galvanized steel sheet according to claim 3, wherein the oxidizing acidic aqueous solution in the first pickling process is: (i) nitric acid or (ii) a mixture of nitric acid and at least one selected from the group consisting of hydrochloric acid, hydrofluoric acid, and sulfuric acid.

5. The method for manufacturing a galvanized steel sheet according to claim 3, wherein the non-oxidizing acidic aqueous solution in the second pickling process is at least one selected from the group consisting of hydrochloric acid, sulfuric acid, phosphoric acid, pyrophosphoric acid, formic acid, acetic acid, citric acid, hydrofluoric acid, and oxalic acid.

6. The method for manufacturing a galvanized steel sheet according to claim 2, wherein the oxidizing acidic aqueous solution in the first pickling process is: (i) nitric acid or (ii) a mixture of nitric acid and at least one selected from the group consisting of hydrochloric acid, hydrofluoric acid, and sulfuric acid.

7. The method for manufacturing a galvanized steel sheet according to claim 2, wherein the non-oxidizing acidic aqueous solution in the second pickling process is at least one selected from the group consisting of hydrochloric acid, sulfuric acid, phosphoric acid, pyrophosphoric acid, formic acid, acetic acid, citric acid, hydrofluoric acid, and oxalic acid.

8. The method for manufacturing a galvanized steel sheet according to claim 1, wherein the chemical composition further comprises, by mass %, at least one selected from the group consisting of:

Mo: 0.01% or more and 0.50% or less,
Cr: 0.60% or less,
Ni: 0.50% or less,
Cu: 1.00% or less,
V: 0.500% or less,
Sb: 0.10% or less,
Sn: 0.10% or less,
Ca: 0.0100% or less, and
REM: 0.010% or less.

9. The method for manufacturing a galvanized steel sheet according to claim 8, wherein the oxidizing acidic aqueous solution in the first pickling process is: (i) nitric acid or (ii) a mixture of nitric acid and at least one selected from the group consisting of hydrochloric acid, hydrofluoric acid, and sulfuric acid.

10. The method for manufacturing a galvanized steel sheet according to claim 8, wherein the non-oxidizing acidic aqueous solution in the second pickling process is at least one selected from the group consisting of hydrochloric acid, sulfuric acid, phosphoric acid, pyrophosphoric acid, formic acid, acetic acid, citric acid, hydrofluoric acid, and oxalic acid.

11. The method for manufacturing a galvanized steel sheet according to claim 1, further comprising a reducing process including heating the steel sheet to a temperature in a range of 600° C. or higher and 900° C. or lower in an atmosphere having an $O_2$ concentration of 0.01 vol % or more and less than 0.1 vol % and a $H_2O$ concentration of 1 vol % or more and 20 vol % or less after the oxidizing process.

12. The method for manufacturing a galvanized steel sheet according to claim 1, wherein the oxidizing acidic aqueous solution in the first pickling process is: (i) nitric acid or (ii) a mixture of nitric acid and at least one selected from the group consisting of hydrochloric acid, hydrofluoric acid, and sulfuric acid.

13. The method for manufacturing a galvanized steel sheet according to claim 1, wherein the non-oxidizing acidic aqueous solution in the second pickling process is at least one selected from the group consisting of hydrochloric acid, sulfuric acid, phosphoric acid, pyrophosphoric acid, formic acid, acetic acid, citric acid, hydrofluoric acid, and oxalic acid.

14. The method for manufacturing a galvanized steel sheet according to claim 1, further comprising an alloying treatment process including performing an alloying treatment on the steel sheet which has been subjected to the galvanizing treatment.

* * * * *